United States Patent [19]

Frenier

[11] Patent Number: 4,623,399

[45] Date of Patent: Nov. 18, 1986

[54] SOLVENT FOR REMOVING IRON OXIDE DEPOSITS

[75] Inventor: Wayne W. Frenier, Tulsa, Okla.

[73] Assignee: Dowell Schlumberger Incorporated, Tulsa, Okla.

[21] Appl. No.: 697,615

[22] Filed: Feb. 4, 1985

[51] Int. Cl.[4] ..... C23G 1/02

[52] U.S. Cl. ..... 134/3; 252/82; 252/142

[58] Field of Search ..... 252/81, 82, 83, 142, 252/79.4; 134/3

[56] References Cited

U.S. PATENT DOCUMENTS

| | | | |
|---|---|---|---|
| 2,882,134 | 4/1959 | Spring | 252/79.4 |
| 3,510,351 | 5/1970 | Dillen | 134/3 |
| 3,527,609 | 9/1970 | Vinso | 134/3 |
| 3,721,629 | 3/1973 | Goodenough | 134/3 |
| 4,430,128 | 2/1985 | Frenier | 134/3 |

*Primary Examiner*—Sam Silverberg

*Attorney, Agent, or Firm*—L. Wayne White

[57] ABSTRACT

Liquid and foam formulations useful for removing iron oxide deposits, for example from heat transfer equipment, comprising an organic solution or foam of N-hydroxylethyl ethylenediamine triacetic acid and an organic acid (for example, formic acid); and a method of removing iron oxide deposits from encrusted equipment surfaces by injecting the liquid or foam formulation, preferably also containing a corrosion inhibitor, into equipment to be cleaned, and circulating the liquid or foam formulation.

25 Claims, No Drawings

SOLVENT FOR REMOVING IRON OXIDE DEPOSITS

BACKGROUND OF THE INVENTION

1. Field Of The Invention

The invention pertains to novel aqueous acid compositions comprising N-hydroxyethyl ethylenediamine triacetic acid (HEDTA), and another organic acid selected from the group consisting of water soluble aliphatic monocarboxylic, aliphatic polycarboxylic, and aliphatic hydroxylated mono- or polycarboxylic acid. Preferably an acid corrosion inhibitor is also present. The invention also pertains to a method of using such compositions to chemically clean (remove) iron oxide scale from metal surfaces and a method of passivating the clean surface against corrosion. 2. Technology Review:

The invention utilizes an organic polycarboxylic acid referred to as N-hydroxyethyl ethylenediamine triacetic acid (abbreviated as HEDTA). This known compound and a method of using it to chemically clean iron oxide scale from metal surfaces is fully disclosed in our U.S. Patent 4,430,128.

HEDTA has also been used as a chelant. Ammoniated or aminated salts of HEDTA have been used as chelants in removing the scale from metal surfaces and for passivating ferrous metal surfaces. The salts were said to be effective against water hardness type scale (i.e. predominantly calcium and/or magnesium salts, such as calcium sulfate, calcium carbonate, etc.) and scales containing a high iron oxide content. However, when ammoniated or aminated salts of HEDTA have been used for chemical cleaning, the pH has generally been weakly acidic or basic, preferably basic. The use of ammoniated ethylenediamine tetraacetric acid (abbreviated as EDTA) to clean and passivate metal surfaces is described in U.S. Pat. No. 3,308,065, No. 3,413,160, and No. 3,438,811. EDTA was normally used as the ammoniated salt, or the sodium salt, at a pH from about 8.5 to about 10.

SUMMARY OF THE INVENTION

The invention provides an improved solvent for removing iron oxide deposits (e.g., scale) from surfaces of articles encrusted with such deposits. The novel solvents are aqueous acid compositions comprising N-hydroxyethyl ethylenediamine triacetic acid and another organic acid selected from the group consisting of water soluble, aliphatic mono- or polycarboxylic acids, which may be hydroxylated. The invention further provides for an improved method of removing iron oxide deposits from encrusted articles. The novel method is particularly useful in cleaning iron oxide deposits from ferrous metal surfaces of heat exchange equipment (e.g., utility boiler tubes and the like). The novel process comprises contacting the iron oxide deposits with the solvent for a time sufficient to dissolve the iron oxide deposits. In this novel chemical cleaning method, the solvent may be used as a liquid or a foam. A preferred chemical cleaning method involves contacting the iron oxide deposit on the equipment to be cleaned with the solvent and thereafter circulating the solvent (as a liquid or a foam) until the amount of chelated or entrained iron, or suspended iron in the liquid or foam, ceases to increase. After iron oxide deposits are removed, the invention provides for passivation of the clean ferrous metal surface and removal of copper from the equipment.

It is an object of the invention to provide an improved solvent comprising N-hydroxyethyl ethylenediamine triacetic acid and another organic acid for removing iron oxide deposits from encrusted equipment surfaces.

It is another object of the invention to provide an improved chemical cleaning method for removing iron oxide deposits from encrusted equipment surfaces using N-hydroxyethyl ethylenediamine triacetic acid and another organic acid.

It is an advantage of the invention that the improved solvent can be made into a stable concentrated solution.

It is another advantage of the invention that the improved chemical cleaning method provides reaction rates for removing iron oxide deposits which are surprisingly high.

Yet another advantage of the invention is that the improved solvent may be used at less than stoichiometric concentrations (based on N-hydroxyethyl ethylenediamine triacetic acid and iron) without significant decrease in the reaction rate.

It is a feature of the invention that if the pH of the improved solvent is raised to at least about 8 after iron oxide removal is complete, then passivation (and copper removal) may be accomplished.

It is another feature of the invention that with an adequate corrosion inhibitor the improved method may be used at temperatures up to about 150° C.

DETAILED DESCRIPTION OF THE INVENTION

The essential components of the novel acid compositions of the present invention are individually well known. N-hydroxyethyl ethylenediamine triacetic acid is a known compound which can be prepared by any of several known techniques, but it is preferably prepared by the process described in D.A. Wilson et al in U.S. Pat. No. 4,212,994. The "other organic acid" used herein is selected from the known class of water soluble, alphatic mono- or polycarboxylic acids, which may be hydroxylated. For example, suitable organic acids include formic acid, acetic acid, propionic acid, oxalic acid, succinic acid, glutaric acid, and the like, and hydroxylated acids (i.e., hydroxy-substituted acids) such as citric acid, glycolic acid (also known as hydroxyacetic acid), lactic acid, and the like may also be used. Water soluble, aliphatic carboxylic acids useful in the present invention are at least five weight percent soluble in water at 20° C., and have one to four carbon atoms in the acid backbone, i.e., the longest chain. Of these acids, formic acid is presently preferred.

A corrosion inhibitor is preferably added to the acid composition. Acid corrosion inhibitors are well known, and any acid corrosion inhibitor may be used provided that it is compatible with N-hydroxyethyl ethylenediamine triacetic acid and the other organic acid used. That is, the corrosion inhibitor must be soluble or dispersible and not substantially retard the efficiency of the HEDTA and other organic acid in removing scale and/or in chelating dissolved iron. Amine-based acid corrosion inhibitors are commonly available and are thus preferred from a commercial standpoint. Suitable corrosion inhibitors include A224 and A251 by Dowell Schlumberger of Tulsa, Okla.

The novel acid compositions preferably have a pH less than about 3. Preferably the pH of the acid composition is from about 1 to about 3. Most preferably, the pH of the acid composition is from about 1.5 to about 2.5.

The ratio of the other organic acid to HEDTA in the novel acid compositions vary from about 0.5 parts (by weight) organic acid/one part (by weight) HEDTA to about one part (by weight) organic acid/one part (by weight) HEDTA. The amount of corrosion inhibitor can likewise be varied. Functionally, the corrosion inhibitor should be present in amounts sufficient to inhibit or prevent acid corrosion of clean base metal (i.e. a corrosion inhibiting amount). Typically, corrosion inhibitors are added in amounts up to about one weight percent, total weight basis.

Suitable other organic acids may be determined by a simple test. The proposed organic acid is mixed with N-hydroxyethyl ethylenediamine triacetic acid in a ratio as described above. The mixture is then tested for its rate of iron oxide dissolution. If the rate of the novel acid mixture exceeds the rate of HEDTA alone at the same temperature, then the tested organic acid is suitable in the practice of the present invention.

The novel aqueous acid compositions can be prepared by merely blending components, i.e. HEDTA, another organic acid, and (preferably) a corrosion inhibitor in a suitable aqueous medium (e.g., water, water-/alkanol solutions, etc.).

The process of cleaning (i.e. removing) predominantly iron oxide scale from ferrous metal surfaces involves contacting such scale encrusted surfaces with the novel acid oompositions of the present invention for a time sufficient to remove the desired amount of scale. Like most chemical reactions, the rate of scale dissolution is increased at higher temperatures. So while ambient temperatures (e.g., about 20° C.) can be used, the process is preferably conducted at an elevated temperature. The upper temperature is bounded only by the thermal stability of the essential components in the novel compositions and by the capacity or ability of the corrosion inhibitor (if present) to function effectively at that temperature. Thus, process temperatures of up to about 150° C. are operable, but temperatures of from about 70° C. to about 85° C. are normally preferred. The reaction rate of scale dissolution is quite acceptable at the preferred temperatures.

After the cleaning process is complete, it is normally desirable to passivate the clean metal surface. This can be accomplished by draining the cleaning composition, rinsing the clean metal surface with water, and then contacting the clean metal surface with a passivating agent. Alternatively, and preferably in many instances, the "spent" acid composition can be transformed into a passivating composition for ferrous metal by neutralizing it with an aqueous base (e.g. ammonium hydroxide, sodium hydroxide, etc.) to a pH of from about 8 to about 10 (preferably about 9) and adding an oxidizing amount of gaseous oxygen, air, hydrogen peroxide and-/or an alkali metal nitrite (for example sodium nitrite) to the neutralized composition. This can be done in situ without any need for the draining and rinsing steps. Passivation is usually accomplished by contacting the clean ferrous metal while it is at least substantially free of iron oxide scale with the "spent" acid composition (as modified) at an elevated temperature. Temperatures of up to about 80° C. are convenient and may be used; temperatures from about 65° C. to about 70° C. are generally preferred. The disclosure of U.S. Pat. No. 3,413,160 by Teumac and U.S. Pat. No. 4,443,268 by Cook are applicable to this passivating step, and the entire disclosure of these patents are hereby incorporated by reference.

The presence of an oxidant in the passivating composition is significant in enhancing the passivation process. The chelated iron in the "spent" acid composition is usually a mixture of chelated ferrous ($Fe^{+2}$ and ferric ($Fe^{+3}$ ions); a ratio which may be determined in the manner disclosed in U.S. Pat. No. 3,413,160. Chelated ferric ion acts as an oxidant in the presence of base metal ($Fe^0$), and so the "spent" acid composition can be neutralized (pH about 8 to 10) and used in passivation, by adding an oxidant to generate ferric ions. If the solution contains an anion that interferes with passivation (such as the sulfate anion), the "spent" solution must be neutralized (pH about 8 to 10) and oxidized with an oxidizing amount of (1) gaseous oxygen or air, and (2) an alkali nitrite. The passivation process can be monitored by measuring the electrical potentials of the metal surface in the passivating composition, as described in U.S. Pat. No. 3,413,160. After passivation is complete, the passivating composition is drained and the passivated surface is flushed with water.

In both the cleaning process step and the passivation step, it is advantageous to "circulate the system" so that fresh solution is continually brought to the metal surface.

The novel acid compositions of the present invention are also useful as foams. Acid foam compositions may be formed with nitrogen or air and a suitable surfactant. Functionally, a suitable surfactant will be present in sufficient quantities to ensure a stable foam. Foam acid compositions are particularly useful in cleaning transfer line exchangers (many small parallel pipes), where a liquid cleaning composition would encounter too great a pressure drop. The method of using the foam acid compositions of the present invention in chemical cleaning is generally similar to the method described for liquid acid compositions above.

EXPERIMENTS

To determine a suitable corrosion inhibitor, a test is performed by adding a measured amount of a corrosion inhibitor composition to an aliquot of a HEDTA/organic acid chemical cleaning solution, the amount of which is determined according to the desired ratio of the exposed metal surface area of a metal test coupon to the volume of cleaning solution (i.e. the S/V ratio), in a 450 ml glass vessel. Metal test coupons are cleaned, weighed, and submersed in the cleaning solution containing corrosion inhibitor. The glass vessel is then placed inside a suitable pressure vessel, such as a Parr bomb, which in turn is immersed in a constant temperature bath for six hours, measured from the time at which the cleaning solution with corrosion inhibitor reaches the desired test temperature. The pressure vessel is then removed from the bath, cooled and emptied. The metal test coupons are rinsed and reweighed. The corrosion rate is calculated by converting weight loss to pounds/-square foot/day. A corrosion inhibitor which achieves a weight loss of less than about 0.05 pounds/square foot/-day is considered satisfactory in the practice of the present invention.

Experiments 1-]

To determine the rate of iron oxide dissolution, two inch samples of once-through tubing were split in half. Three ½ sections were used in every test. Two hundred and fifty mL of $H_2O$ containing the appropriate inhibitor (0.3% A224 by Dowell Schlumberger of Tulsa, Okla.) was heated to the test temperature and the concentrated solvent (same) was injected. The iron concentration was determined periodically with an IL157 atomic absorption spectrophotometer. The first order rate coefficients, k ($hr^{-1}$) are shown in the table below.

| HEDTA/ORGANIC ACIDS 200° F. | | | |
|---|---|---|---|
| SOLVENT | pH | TOTAL (molal) | k ($hr^{-1}$) |
| FORMIC | 2.3 | 1.1 | 1.1 |
| CITRIC | 2.3 | 0.2 | 1.02 |
| GLYCOLIC | 2.3 | 0.5 | 0.99 |
| HEDTA | 2.3 | 0.14 | 1.0 |
| 1/1 HEDTA-FORMIC | 2.3 | 1.0 | 2.1 |
| 1/1 HEDTA-CITRIC | 2.2 | 0.25 | 2.3 |
| 1/1 HEDTA-GLYCOLIC | 2.2 | 0.48 | 1.7 |
| 2/1 GLYCOLIC-FORMIC | 3.0 | 0.47 | 1.0 |
| 1/2 FORMIC-CITRIC | 3.0 | 0.37 | 0.95 |

The ratios in Experiments 5 to 9 are weight ratios. At 200° F. the HEDTA/formic acid formulations were about twice as fast as the other solvents, which were grouped around k=1.0. Several things were revealed by this series of tests. First, the additional rate increase is due to molecular formic acid, not pH lowering and the effects of formic acid and HEDTA appear to be additive. Second, HEDTA/formic acid compositions can be used at substoichiometric concentrations (based on HEDTA and iron) without reducing the rate substantially.

The first order rate coefficient (k) is calculated on a very simple model that assumes that the entire dissolution/corrosion process can be approximated by a first order decomposition rate law.

$$\underset{(A)}{\text{Fe (solid)}} \longrightarrow \underset{(X)}{\text{Fe (Solution)}}:$$

$$\frac{dx}{dt} = k(A - X)$$

Integration gives ln (A/(A−X))=kt. A straight line plot of ln (A/(A−X)) versus t gives k. The final iron concentration is used as A. This is valid in most cases since the tubes were 100% clean after six hours. The k value was calculated using a least-squares program on a HP41CB calculator.

It is understood that various other modifications will be apparent to and can readily be made by those skilled in the art without departing from the scope and spirit of this invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. An improved aqueous acid composition to dissolve iron oxide deposits, comprising:

(a) N-hydroxyethyl ethylenediamine triacetic acid, and (b) an organic acid selected from the group consisting of water soluble aliphatic monocarboxylic, aliphatic polycarboxylic, and aliphatic hydroxylated mono- or polycarboxylic acid, in an amount effective to increase the rate of dissolution of iron oxide deposits beyond the rate of dissolution thereof by the composition absent said organic acid, said aqueous acid composition having a pH less than about 3.

2. The aqueous acid composition set forth in claim 1, including a corrosion inhibitor.

3. The aqueous acid set forth in claim 2, wherein (b) is formic acid.

4. The aqueous acid set forth in claim 2, wherein (b) is acetic acid.

5. The aqueous acid set forth in claim 2, wherein (b) is propionic acid.

6. The aqueous acid set forth in claim 2, wherein (b) is fumaric acid.

7. The aqueous acid set forth in claim 2, wherein (b) is maleic acid.

8. The aqueous acid set forth in claim 2, wherein (b) is citric acid.

9. The aqueous acid set forth in claim 2, wherein (b) is glycolic acid.

10. The aqueous acid set forth in claim 2, wherein (b) is lactic acid.

11. The aqueous acid composition set forth in claim 2, wherein (b) is a water soluble aliphatic carboxylic acid having one to four carbon atoms in its longest chain.

12. A process for dissolving iron oxide deposits on a ferrous metal surface, comprising:

contacting said iron oxide deposits with an aqueous acid composition comprising N-hydroxyethyl ethylenediamine triacetic acid, and an organic acid selected from the group consisting of water soluble aliphatic monocarboxylic, aliphatic polycarboxylic, and aliphatic hydroxylated mono- or polycarboxylic acid, in an amount effective to increase the rate of dissolution of iron oxide deposits beyond the rate of dissolution thereof by the composition absent said organic acid said aqueous acid composition having a pH less than about 3 for a time sufficient to dissolve said iron oxide deposits.

13. The process set forth in claim 12, including dissolving said iron oxide deposits in said aqueous acid composition until said ferrous metal surface is at least substantially free of iron oxide deposits.

14. The process set forth in claim 13, including passivating said ferrous metal surface at least substantially free of iron oxide deposits with an alkaline liquid having an oxidant dissolved, dispersed, or entrained therein.

15. The process set forth in claim 13, wherein said alkaline liquid has a pH of from about 8 to about 10.

16. The process set forth in claim 13, wherein said oxidant is gaseous oxygen or gaseous air, and an alkali metal nitrite.

17. The process set forth in claim 13, wherein said aqueous acid composition contacts and dissolves said iron oxide deposits at a temperature from about 70° C. to about 85° C.

18. The process set forth in claim 14, wherein said alkaline liquid and oxidant passivate said ferrous metal surface at a temperature from about 65° C. to about 70° C.

19. The process set forth in claim 14, wherein said oxidant is ferric salt of N-hydroxyethyl ethylenediamine triacetic acid.

20. The process set forth in claim 12, wherein said aqueous acid composition is a liquid.

21. The process set forth in claim 12, wherein said aqueous acid composition is a foam.

22. The process set forth in claim 12, wherein the pH of the composition is no greater than 2.5.

23. The process set forth in claim 13, wherein the pH of the composition is no greater than 2.5 and is at least about 1.5.

24. The process set forth in claim 22, wherein the ratio by weight of said organic acid to N-hydroxyethyl ethylenediamine triacetic acid, is between 1/2 to about 1/1.

25. The process set forth in claim 23 wherein, said organic acid is formic acid, citric acid or glycolic acid.

* * * * *